US008905840B2

(12) United States Patent
Arnone et al.

(10) Patent No.: US 8,905,840 B2
(45) Date of Patent: Dec. 9, 2014

(54) SUBSTITUTION HYBRID GAMES

(71) Applicant: Gamblit Gaming, LLC, Glendale, CA (US)

(72) Inventors: Miles Arnone, Sherborn, MA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 13/962,815

(22) Filed: Aug. 8, 2013

(65) Prior Publication Data

US 2013/0324229 A1 Dec. 5, 2013

Related U.S. Application Data

(63) Continuation of application No. PCT/US2012/066684, filed on Nov. 27, 2012.

(60) Provisional application No. 61/629,872, filed on Nov. 30, 2011.

(51) Int. Cl.
*A63F 9/24* (2006.01)
*G07F 17/32* (2006.01)

(52) U.S. Cl.
CPC ..... *G07F 17/3244* (2013.01); *G07F 17/326* (2013.01)
USPC ..... 463/25; 463/9; 463/42

(58) Field of Classification Search
USPC ..... 463/7, 9, 16, 25, 40–42
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 6,050,895 | A | 4/2000 | Luciano |
| 6,227,974 | B1 | 5/2001 | Eilat |
| 6,267,669 | B1 | 7/2001 | Luciano |
| 6,712,693 | B1 | 3/2004 | Hettinger |
| 6,761,632 | B2 | 7/2004 | Bansemer et al. |

(Continued)

FOREIGN PATENT DOCUMENTS

| | | | |
|---|---|---|---|
| JP | 2001300098 | A | 10/2001 |
| JP | 2003111980 | A | 4/2003 |

(Continued)

OTHER PUBLICATIONS

WIPO/IPEA International Preliminary Report on Patentability, PCT/US12/66684, Aug. 29, 2013.

(Continued)

*Primary Examiner* — Damon Pierce
(74) *Attorney, Agent, or Firm* — Frank Cire

(57) ABSTRACT

Systems and methods in accordance with embodiments of the invention operate a substitution hybrid game including: a gambling game; a multiplayer entertainment game that triggers at least one wager in the gambling game; a substitution module constructed to access a database containing player profiles associated with players of the substitution hybrid game, and the substitution module is constructed to: detect a substitution request from a human player via a user interface concerning a gameplay session of the substitution hybrid game, where a player profile within the database describes the human player; evaluate whether the substitution request involves a substitution of players that satisfies at least one substitution standard using at least the player profile that describes the human player; and perform the requested player substitution when the substitution request satisfies the at least one substitution standard.

14 Claims, 10 Drawing Sheets

(56) References Cited

U.S. PATENT DOCUMENTS

| | | | |
|---|---|---|---|
| 6,761,633 | B2 | 7/2004 | Riendeau |
| 6,764,397 | B1 | 7/2004 | Robb |
| 6,811,482 | B2 | 11/2004 | Letovsky |
| 7,118,105 | B2 | 10/2006 | Benevento |
| 7,294,058 | B1 | 11/2007 | Slomiany |
| 7,326,115 | B2 | 2/2008 | Baerlocher |
| 7,361,091 | B2 | 4/2008 | Letovsky |
| 7,517,282 | B1 | 4/2009 | Pryor |
| 7,575,517 | B2 | 8/2009 | Parham et al. |
| 7,682,239 | B2 | 3/2010 | Friedman et al. |
| 7,720,733 | B2 | 5/2010 | Jung |
| 7,753,770 | B2 | 7/2010 | Walker et al. |
| 7,753,790 | B2 | 7/2010 | Nguyen |
| 7,775,885 | B2 | 8/2010 | Van Luchene |
| 7,798,896 | B2 | 9/2010 | Katz |
| 7,828,657 | B2 | 11/2010 | Booth |
| 7,917,371 | B2 | 3/2011 | Jung et al. |
| 7,938,727 | B1 | 5/2011 | Konkle |
| 7,967,674 | B2 | 6/2011 | Baerlocher |
| 7,980,948 | B2 | 7/2011 | Rowe |
| 7,996,264 | B2 | 8/2011 | Kusumoto et al. |
| 8,012,023 | B2 | 9/2011 | Gates |
| 8,047,915 | B2 | 11/2011 | Lyle |
| 8,060,829 | B2 | 11/2011 | Jung et al. |
| 8,075,383 | B2 | 12/2011 | Friedman et al. |
| 8,087,999 | B2 | 1/2012 | Oberberger |
| 8,113,938 | B2 | 2/2012 | Friedman et al. |
| 8,118,654 | B1 | 2/2012 | Nicolas |
| 8,128,487 | B2 | 3/2012 | Hamilton et al. |
| 8,135,648 | B2 | 3/2012 | Oram |
| 8,137,193 | B1 | 3/2012 | Kelly et al. |
| 8,157,653 | B2 | 4/2012 | Buhr |
| 8,167,699 | B2 | 5/2012 | Inamura |
| 8,177,628 | B2 | 5/2012 | Manning |
| 8,182,338 | B2 | 5/2012 | Thomas |
| 8,182,339 | B2 | 5/2012 | Anderson |
| 8,187,068 | B2 | 5/2012 | Slomiany |
| 8,206,210 | B2 | 6/2012 | Walker |
| 2001/0004609 | A1 | 6/2001 | Walker et al. |
| 2001/0019965 | A1 | 9/2001 | Ochi |
| 2002/0022509 | A1 | 2/2002 | Nicastro |
| 2002/0090990 | A1 | 7/2002 | Joshi et al. |
| 2002/0175471 | A1 | 11/2002 | Faith |
| 2003/0060286 | A1 | 3/2003 | Walker et al. |
| 2003/0119576 | A1 | 6/2003 | McClintic et al. |
| 2003/0139214 | A1 | 7/2003 | Wolf et al. |
| 2003/0171149 | A1 | 9/2003 | Rothschild |
| 2003/0211879 | A1 | 11/2003 | Englman |
| 2004/0092313 | A1 | 5/2004 | Saito et al. |
| 2004/0102238 | A1 | 5/2004 | Taylor |
| 2004/0121839 | A1 | 6/2004 | Webb |
| 2004/0225387 | A1 | 11/2004 | Smith |
| 2005/0003878 | A1 | 1/2005 | Updike |
| 2005/0096124 | A1 | 5/2005 | Stronach |
| 2005/0116411 | A1 | 6/2005 | Herrmann et al. |
| 2005/0192087 | A1 | 9/2005 | Friedman et al. |
| 2005/0233791 | A1 | 10/2005 | Kane |
| 2005/0233806 | A1 | 10/2005 | Kane et al. |
| 2005/0239538 | A1 | 10/2005 | Dixon |
| 2005/0269778 | A1 | 12/2005 | Samberg |
| 2005/0288101 | A1 | 12/2005 | Lockton et al. |
| 2006/0003823 | A1 | 1/2006 | Zhang |
| 2006/0003830 | A1 | 1/2006 | Walker et al. |
| 2006/0040735 | A1 | 2/2006 | Baerlocher |
| 2006/0068913 | A1 | 3/2006 | Walker et al. |
| 2006/0084499 | A1 | 4/2006 | Moshal |
| 2006/0084505 | A1 | 4/2006 | Yoseloff |
| 2006/0135250 | A1 | 6/2006 | Rossides |
| 2006/0154710 | A1 | 7/2006 | Serafat |
| 2006/0166729 | A1 | 7/2006 | Saffari et al. |
| 2006/0189371 | A1 | 8/2006 | Walker et al. |
| 2006/0234791 | A1 | 10/2006 | Nguyen et al. |
| 2006/0258433 | A1 | 11/2006 | Finocchio et al. |
| 2007/0035548 | A1 | 2/2007 | Jung et al. |
| 2007/0038559 | A1 | 2/2007 | Jung et al. |
| 2007/0064074 | A1 | 3/2007 | Silverbrook et al. |
| 2007/0087799 | A1 | 4/2007 | Van Luchene |
| 2007/0093299 | A1 | 4/2007 | Bergeron |
| 2007/0117641 | A1 | 5/2007 | Walker et al. |
| 2007/0129149 | A1 | 6/2007 | Walker |
| 2007/0156509 | A1 | 7/2007 | Jung et al. |
| 2007/0167212 | A1 | 7/2007 | Nguyen |
| 2007/0167239 | A1 | 7/2007 | O'Rourke |
| 2007/0191104 | A1 | 8/2007 | Van Luchene |
| 2007/0203828 | A1 | 8/2007 | Jung et al. |
| 2007/0293306 | A1 | 12/2007 | Nee et al. |
| 2008/0004107 | A1 | 1/2008 | Nguyen et al. |
| 2008/0014835 | A1 | 1/2008 | Weston et al. |
| 2008/0015004 | A1 | 1/2008 | Gatto et al. |
| 2008/0070659 | A1 | 3/2008 | Naicker |
| 2008/0070690 | A1 | 3/2008 | Van Luchene |
| 2008/0070702 | A1 | 3/2008 | Kaminkow |
| 2008/0096665 | A1 | 4/2008 | Cohen |
| 2008/0108425 | A1 | 5/2008 | Oberberger |
| 2008/0119283 | A1 | 5/2008 | Baerlocher |
| 2008/0146308 | A1 | 6/2008 | Okada |
| 2008/0176619 | A1 | 7/2008 | Kelly |
| 2008/0191418 | A1 | 8/2008 | Lutnick et al. |
| 2008/0195481 | A1 | 8/2008 | Lutnick |
| 2008/0248850 | A1 | 10/2008 | Schugar |
| 2008/0254893 | A1 | 10/2008 | Patel |
| 2008/0274798 | A1 | 11/2008 | Walker et al. |
| 2008/0311980 | A1 | 12/2008 | Cannon |
| 2008/0318668 | A1 | 12/2008 | Ching |
| 2009/0011827 | A1 | 1/2009 | Englman |
| 2009/0023489 | A1 | 1/2009 | Toneguzzo |
| 2009/0023492 | A1 | 1/2009 | Erfanian |
| 2009/0061974 | A1 | 3/2009 | Lutnick et al. |
| 2009/0082093 | A1 | 3/2009 | Okada |
| 2009/0098934 | A1 | 4/2009 | Amour |
| 2009/0118006 | A1 | 5/2009 | Kelly et al. |
| 2009/0124344 | A1 | 5/2009 | Mitchell et al. |
| 2009/0131158 | A1 | 5/2009 | Brunet De Courssou et al. |
| 2009/0131175 | A1 | 5/2009 | Kelly et al. |
| 2009/0143141 | A1 | 6/2009 | Wells |
| 2009/0149233 | A1 | 6/2009 | Strause et al. |
| 2009/0156297 | A1 | 6/2009 | Andersson et al. |
| 2009/0176560 | A1 | 7/2009 | Herrmann et al. |
| 2009/0176566 | A1 | 7/2009 | Kelly |
| 2009/0221355 | A1 | 9/2009 | Dunaevsky et al. |
| 2009/0247272 | A1 | 10/2009 | Abe |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0035674 | A1 | 2/2010 | Slomiany |
| 2010/0056247 | A1 | 3/2010 | Nicely |
| 2010/0062836 | A1 | 3/2010 | Young |
| 2010/0093420 | A1 | 4/2010 | Wright |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0045896 | A1 | 2/2011 | Sak et al. |
| 2011/0077087 | A1 | 3/2011 | Walker et al. |
| 2011/0082571 | A1 | 4/2011 | Murdock et al. |
| 2011/0109454 | A1 | 5/2011 | Mcsheffrey |
| 2011/0111837 | A1 | 5/2011 | Gagner |
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers et al. |
| 2011/0212767 | A1 | 9/2011 | Barclay |

(56) References Cited

U.S. PATENT DOCUMENTS

| | | | |
|---|---|---|---|
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0202587 | A1 | 8/2012 | Allen |
| 2012/0322545 | A1 | 12/2012 | Arnone et al. |

FOREIGN PATENT DOCUMENTS

| | | | |
|---|---|---|---|
| JP | 2004097610 | A | 4/2004 |
| JP | 2004166746 | A | 6/2004 |
| WO | 9851384 | A1 | 11/1998 |
| WO | 2010087090 | A1 | 8/2010 |
| WO | 2012139083 | A1 | 10/2012 |
| WO | 2013082052 | A1 | 6/2013 |
| WO | 2013082546 | A1 | 6/2013 |
| WO | 2013082552 | A1 | 6/2013 |

OTHER PUBLICATIONS

ITL.NIST.GOV, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

Changing the Virtual Self: Avatar Transformations in Popular Games; Barr et al., Victoria Univ., NZ, 2006.

Real-Time Multimodal Human—Avatar Interaction; Li et al., IEEE (Video Technology) vol. 18, No. 4, 2008.

U.S. Appl. No. 13/854,658, Arnone, et al., filed Apr. 1, 2013.

U.S. Appl. No. 13/855,676, Arnone, et al., filed Apr. 2, 2013.

U.S. Appl. No. 13/872,946, Arnone, et al., filed Apr. 29, 2013.

U.S. Appl. No. 13/886,245, Arnone, et al., filed May 2, 2013.

U.S. Appl. No. 13/888,326, Arnone, et al., filed May 6, 2013.

U.S. Appl. No. 13/890,207, Arnone, et al., filed May 8, 2013.

U.S. Appl. No. 13/896,783, Arnone, et al., filed May 17, 2013.

U.S. Appl. No. 13/898,222, Arnone, et al., filed May 20, 2013.

U.S. Appl. No. 13/900,363, Arnone, et al., filed May 22, 2013.

U.S. Appl. No. 13/903,895, Arnone, et al., filed May 28, 2013.

U.S. Appl. No. 13/917,513, Arnone, et al., filed Jun. 13, 2013.

U.S. Appl. No. 13/917,529, Arnone, et al., filed Jun. 13, 2013.

U.S. Appl. No. 13/920,031, Arnone, et al., filed Jun. 17, 2013.

U.S. Appl. No. 13/928,166, Arnone, et al., filed Jun. 26, 2013.

U.S. Appl. No. 13/935,410, Arnone, et al., filed Jul. 3, 2013.

U.S. Appl. No. 13/935,468, Arnone, et al., filed Jul. 3, 2013.

International Search Report and Written Opinion, PCT/US2012/66684, Mar. 19, 2013.

SUBSTITUTION HYBRID GAMES

CROSS REFERENCE TO RELATED APPLICATIONS

This application is a continuation of Patent Cooperation Treaty Application No. PCT/US12/66684, filed on Nov. 27, 2012 which claims the benefit of U.S. Provisional Patent Application No. 61/629,872 filed on Nov. 30, 2011 and is related to PCT patent application No. PCT/US11/26768, filed Mar. 1, 2011, PCT patent application No. PCT/US11/63587, filed on Dec. 6, 2011, and PCT patent application No. PCT/US12/58156, filed on Sep. 29, 2012, the contents of each of which are hereby incorporated by reference in its entirety as if stated in full herein.

FIELD OF THE INVENTION

Embodiments of the present invention are generally related to gaming and more specifically to a substitution hybrid game that includes both an entertainment game and a gambling game capable of substituting players during multiplayer gameplay.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Systems and methods in accordance with embodiments of the invention operate a substitution hybrid game. One embodiment includes a substitution hybrid game, including: a real world engine constructed to provide a randomly generated payout of real world credits from at least one wager in a gambling game; an entertainment software engine constructed to execute a multiplayer entertainment game providing outcomes upon a player's skillful execution of the entertainment game to earn a payout of game world credits; and a game world engine constructed to manage the entertainment software engine and communicate gameplay gambling event occurrences based upon a player's skillful execution of the entertainment game that trigger at least one wager in the gambling game to the gambling game; where the game world engine utilizes a substitution module constructed to access a database containing player profiles associated with players of the substitution hybrid game, and the substitution module is constructed to: detect a substitution request from a human player via a user interface concerning a gameplay session, where a player profile within the database describes the human player; evaluate whether the substitution request involves a substitution of players that satisfies at least one substitution standard using at least the player profile that describes the human player; and perform the requested player substitution when the substitution request satisfies the at least one substitution standard.

In a further embodiment, the at least one substitution standard is based upon the player profile describing the human player from whom the substitution request is received and a player profile describing at least one other player.

In another embodiment, the substitution request is for the human player to substitute for a computer player engaged in the gameplay session; and the computer player is generated using a computer player profile that determines the performance of the computer player as the computer player progresses within the gameplay session.

In a still further embodiment, the substitution request is for the human player to substitute for a human player engaged in the gameplay session.

In still another embodiment, the human player is engaged in the gameplay session; and the substitution request is for a player to substitute for the human player.

In a yet further embodiment, the player substituted for the human player is a computer player generated using a computer player profile that determines the performance of the computer player as the computer player progresses within the gameplay session.

In yet another embodiment, at least one substitution standard allows the human player in the gameplay session to substitute for a computer player when the player profile describing the human player indicates the same skill level as the computer player's computer player profile; and the computer player is generated using a computer player profile that determines the performance of the computer player as the computer player progresses within the gameplay session.

In a further embodiment again, at least one substitution standard allows the human player in the gameplay session to substitute for a player when a human player's human player profile is attributed with a sufficient amount of RWC that can be expended to generate elements in the gameplay session.

In another embodiment again, at least one substitution standard allows a player in the gameplay session to substitute for the human player when the player's player profile is at the same skill level as the human player's human player profile.

In a further additional embodiment, the substitution module is further constructed to: detect whether a minimum number of players is present; and add at least one computer player generated using a computer player profile when the minimum number of players is not present, where the computer player profile determines the performance of a computer player as a computer player progresses within the gameplay session.

In another additional embodiment, at least one substitution standard is specified by the human player in the gameplay session.

In a still yet further embodiment, the substitution module is constructed to execute on the game world engine.

In still yet another embodiment, the substitution module is constructed to execute on a substitution server and communicate with the game world engine via a network.

In a still further embodiment again, the substitution module is constructed to execute on a game world patron management server and communicate with the game world engine via a network.

In still another embodiment again, the requested player substitution is performed by the human player assuming the role of the player that the human player substitutes for in the gameplay session.

A still further additional embodiment includes a method of operating a substitution hybrid game, the method including: detecting a substitution request from a human player via a user interface concerning a gameplay session of the substitution hybrid game, where a player profile within the database describes the human player utilizing a substitution module utilized by a game world engine, where: the substitution module is constructed to access a database containing player profiles associated with players of the substitution hybrid game; and the game world engine is constructed to communicate gameplay gambling event occurrences based upon a player's skillful execution of a multiplayer entertainment game to earn a payout of gameplay resources in the form of game world credits as detected by an entertainment software engine that triggers at least one wager in a gambling game to the gambling game including a real world engine constructed to provide at least one wager as a randomly generated payout of gameplay resources in the form of real world credits for the gambling game; evaluating whether the substitution request involves a substitution of players that satisfies at least one substitution standard using at least the player profile that describes the human player using the substitution module; and performing the requested player substitution when the substitution request satisfies the at least one substitution standard using the substitution module.

In still another additional embodiment, the substitution request is for the human player to substitute for a computer player engaged in the gameplay session; and the computer player is generated using a computer player profile that determines the performance of the computer player as the computer player progresses within the gameplay session.

In a yet further embodiment again, the substitution request is for the human player to substitute for a human player engaged in the gameplay session.

In yet another embodiment again, the human player is engaged in the gameplay session; and the substitution request is for a player to substitute for the human player.

A yet further additional embodiment, includes a machine readable medium containing processor instructions, where execution of the instructions by a processor causes the processor to perform a process including: detecting a substitution request from a human player via a user interface concerning a gameplay session of a substitution hybrid game, where a player profile within the database describes the human player utilizing a substitution module utilized by a game world engine, where: the substitution module is constructed to access a database containing player profiles associated with players of the substitution hybrid game; and the game world engine is constructed to communicate gameplay gambling event occurrences based upon a player's skillful execution of a multiplayer entertainment game to earn a payout of gameplay resources in the form of game world credits as detected by an entertainment software engine that triggers at least one wager in a gambling game to the gambling game including a real world engine constructed to provide at least one wager as a randomly generated payout of gameplay resources in the form of real world credits for the gambling game; evaluating whether the substitution request involves a substitution of players that satisfies at least one substitution standard using at least the player profile that describes the human player using the substitution module; and performing the requested player substitution when the substitution request satisfies the at least one substitution standard using the substitution module.

DETAILED DESCRIPTION

Figure 1:
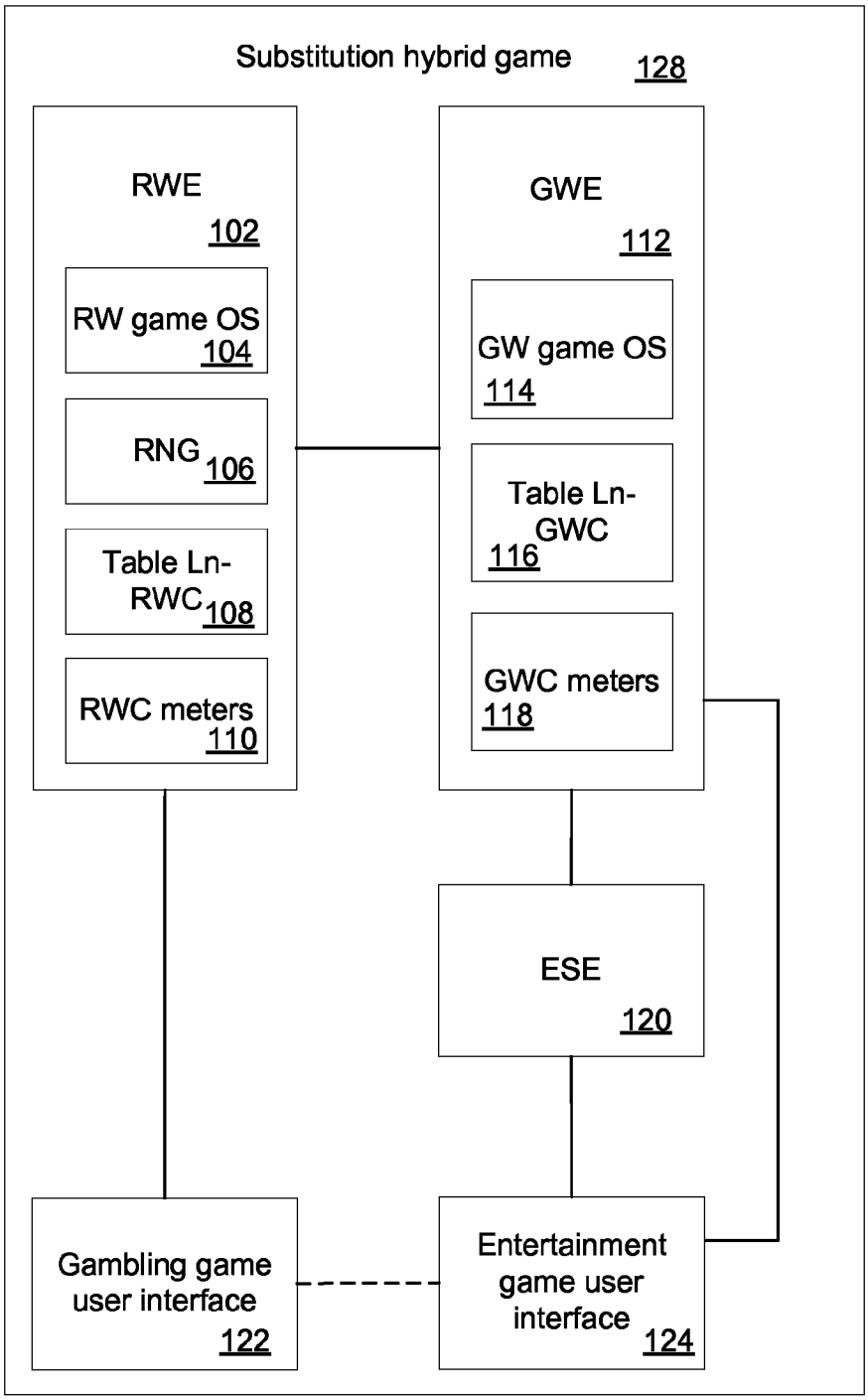
FIG. 1 illustrates a substitution hybrid game in accordance with an embodiment of the invention.

Turning now to the drawings, systems and methods for operation of a substitution hybrid game are illustrated. In several embodiments, a substitution hybrid game is a form of a hybrid game that integrates a substitution module with both a gambling game that includes a real world engine (RWE) which manages the gambling game, as well as an entertainment game that includes a game world engine (GWE) which manages the entertainment portion of a game, and an entertainment software engine (ESE) which executes the entertainment game for user entertainment. In certain embodiments, the substitution hybrid game also includes a user interface associated with either or both the gambling game and the entertainment game. In operation of a substitution hybrid game, a player acts upon various types of elements of the entertainment game in a game world environment. Upon acting on some of these elements, a wager is triggered in the gambling game. In playing the entertainment game, using the elements, a player can consume and accrue game world credits (GWC) within the entertainment game. These credits can be in the form of (but are not limited to) game world objects, experience points, or points generally. Wagers are made in the gambling game using real world credits (RWC). The real world credits can be credits in an actual currency, or may be credits in a virtual currency which has real world value. Gambling outcomes from the gambling game may cause consumption, loss or accrual of RWC. In addition, gambling outcomes in the gambling game may influence elements in the entertainment game such as (but not limited to) by restoring a consumed element, causing the loss of an element, restoration or placement of a fixed element. Example elements include enabling elements (EE) which are elements that enable a player's play of the entertainment game and whose consumption by the player while playing the entertainment game may trigger a wager in a gambling game. In addition, EE may also be replenished during play within the entertainment game based on an outcome of a triggered wager. Other types of elements include actionable elements (AE) which are elements that are acted upon to trigger a wager in the gambling game and may not be restorable during normal play of the entertainment game. Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety.

In many embodiments, a substitution hybrid game utilizing a substitution module enables players during multiplayer gameplay to be replaced with each other in accordance with a substitution standard enforced by the substitution hybrid game. In a number of embodiments, players have associated player profiles and substitutions between human players and/or computer players are performed based upon their corresponding profiles. In several embodiments, player profiles can be a human player profile or a computer player profile. A human player profile can include information used to identify interactions with a substitution hybrid game generated at a user interface with a human player and stores information concerning the interactions between the human player and the substitution hybrid game. A computer player profile can include information from which an automated player, which can also be referred to as a computer player, can be executed by the substitution hybrid game to progress through a gameplay session. A computer player profile can also include information that determines the performance of the computer player as the computer player progresses within a gameplay session. The information in each player profile can include characteristics of the player associated with the player profile such as (but not limited to) an identity from which to ascribe communication generated from a human player at a user interface, gameplay preferences, skill level and/or a gameplay history.

When there is an insufficient number of human players associated with human player profiles committed to the multiplayer gameplay session, a substitution hybrid game in accordance with many embodiments of the invention can satisfy a minimum number of players requirement within a particular multiplayer gameplay session by utilizing an appropriate number of computer players associated with computer player profiles as substitutes for human players. Substitution hybrid games can also process requests from a human player associated with a human player profile to allow the human player to substitute for a computer player during multiplayer gameplay. Similarly, a substitution hybrid game can process requests from a human player associated with a human player profile to leave multiplayer gameplay by finding a substitute human player or computer player to replace the human player that generated a request to leave multiplayer gameplay. Also, a substitution module can perform processes that enable a substituting human player associated with a human player profile to seamlessly enter multiplayer gameplay by generating elements required for the substituting human player to enter the multiplayer gameplay from the gameplay resources (such as but not limited to RWC, GWC, EE and AE) previously associated with the player to be replaced.

In many embodiments, a substitution module coordinates interactions between a human player associated with a human player profile and the substitution hybrid game. This coordination enables a human player associated with a human player profile to substitute for players of a substitution hybrid game or be replaced with players of a substitution hybrid game or to take part in gameplay in which the players are substitutable with other players. In numerous embodiments, a substitution module can be implemented locally on a substitution hybrid game within the GWE, remotely on a substitution server accessible to a sponsored hybrid game or a game world patron management server via a network or as a distributed system where processes of a substitution module occur locally on a sponsored hybrid game and on a remote server.

Substitution modules in accordance with many embodiments of the invention can coordinate the substitution of players during multiplayer gameplay in a seamless fashion without interruption of gameplay. Each substitution can be made in accordance with one or more substitution standards that govern the substitution. A substitution standard can be generated by a human player and associated with the human player profile of the human player or generated by an operator of a substitution hybrid game such as (but not limited to) a casino that hosts the substitution hybrid game. In many embodiments, a player substituted for another player can assume the role of the player substituted out with the same aspects of gameplay as the player substituted out. In several embodiments, a substituted player commences gameplay from the same or a similar location within a game to the last location of the player substituted out of the game. In many embodiments, the substituted character can assume a number of characteristics of the player substituted out of the game including (but not limited to) the same or a similar inventory within a game, and/or the same or a similar score within a game. Substitution hybrid games in accordance with embodiments of the invention are discussed below.

Substitution Hybrid Games

In many embodiments, a substitution hybrid game integrates high levels of entertainment content with a game of skill (entertainment game), a gambling experience with a game of chance (gambling game). A substitution hybrid game provides for random outcomes independent of player skill while providing that the user's gaming experience (as measured by obstacles/challenges encountered, time of play and other factors) is shaped by the player's skill. A substitution hybrid game in accordance with an embodiment of the invention is illustrated in FIG. 1. The substitution hybrid game 128 includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, the RWE 102 is the operating system for the gambling game of the skill calibrated hybrid game 128 and controls and operates the gambling game. The operation of a gambling game is enabled by RWC, such as money or other real world funds. A gambling game can increase or decreases an amount of RWC based on random gambling outcomes, where the gambling proposition of a gambling game is typically regulated by gaming control bodies. In many embodiments, the RWE includes a RW operating system (OS) 104, random number generator (RNG) 106, level "n" real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level "n" real-world credit pay table (Table Ln-RWC) 108 is a table that can be used in conjunction with a random number generator (RNG) 106 to dictate the real world credits (RWC) earned as a function of sponsored gameplay and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a cash out is opted for by a player. The amount of RWC required to enter a specific level of the game "level n" need not be the same for each level.

In many embodiments, the GWE 112 manages the overall substitution hybrid game operation, with the RWE 102 and the ESE 120 effectively being support units to the GWE 112. In several embodiments, the GWE 112 contains mechanical, electronic and software system for an entertainment game. The GWE 112 includes a GW game operating system (OS) 114 that provides control of the entertainment game. The GWE additionally contains a level "n" game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120. The GWE can also be used to implement a substitution module that enables substitutions between players of a multiplayer entertainment game, where the substituted players are associated with a human player profile or a computer player profile.

In many embodiments, a level "n" game world credit pay table (Table Ln-GWC) 116 dictates the GWC earned as a function of player skill in the nth level of the game. The payouts governed by this table are dependent upon player skill and sponsored gameplay at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each entertainment game has one or more scoring criterion, embedded within the Table Ln-GWC 116 that reflects player performance against the goal(s) of the game. GWC can be carried forward from one level of sponsored gameplay to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a necessary status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the players user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of a substitution hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 may send certain GW game control parameters and elements to the ESE 120 to affect its play, such as (but not limited to) what level of character to be using, changing the difficulty level of the game, changing the type of gun or car in use, and/or requesting portions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's processes may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special portion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In a particular embodiment, the RWE 102 operation can be a game of chance as a gambling game running every 10 seconds where the amount wagered is communicated from the GWE 112 as a function of choices the player makes in the operation profile in the entertainment game such as those cited above.

In many embodiments, a substitution hybrid game integrates a video game style gambling machine, where the gambling game (i.e. RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate "garners" can be established with the entertainment game. In several embodiments, the substitution hybrid game can leverage very popular titles with "gamers" and provides a sea change environment for casinos to attract players with games that are more akin to the type of entertainment that a younger generation desires. In various embodiments, players can use their skill towards building and banking GWC that in turn can be used to win tournaments and various prizes as a function of their "gamer" prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, substitution hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE, the outcomes of which are dependent at least in part on skill. The substitution hybrid game can include an entertainment game that includes head-to-head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

In many embodiments, if an entertainment game includes a version of Madden Football™ a player can bet on whether or not the player is going to beat the computer, or if the player is playing against another player, that other player. These bets can be made, for example, on the final outcome of the game, and/or the state of the game along various intermediary points (such as but not limited to the score at the end of the 1st quarter) and/or on various measures associated with the game (such as but not limited to the total offensive yards, number of turnovers, or number of sacks). Players can bet against one another, or engage the computer in a head-to-head competition in the context of their skill level in the entertainment game in question. As such, players can have a handicap associated with their player profile that describes their skill (which can be their "professed skill" in certain embodiments), and which is used by a GWE (such as a local GWE or a GWE that receives services from remote servers) to offer appropriate bets around the final and/or intermediate outcomes of the entertainment game, and/or to condition sponsored gameplay as a function of player skill, and/or to select players across one or more substitution hybrid games to participate in head to head games and/or tournaments.

Many embodiments enable the maximization of the number of players able to compete competitively by utilizing a skill normalization module. Handicapping enables players of varying performance potential to compete competitively regardless of absolute skill level, such as but not limited to where a player whose skill level identifies the player as a beginner can compete in head-to-head or tournament play against a highly skilled player with meaningful results.

In several embodiments, wagers can be made among numerous substitution hybrid games with a global betting manager (GBM). The GBM is a system that coordinates wagers that are made across multiple substitution hybrid games by multiple players. In some implementations it can also support wagers by third parties relative to the in game performance of other players. The GBM can stand alone, or is capable of being embedded in one of a number of systems, including a GWE, ESE or any remote server capable of providing services to a substitution hybrid game, or can operate independently on one or a number of servers on-site at a casino, as part of a larger network and/or the internet or "cloud" in general. The GBM also supports the management of lottery tickets issued as a function of sponsored gameplay.

Although various components of substitution hybrid games are discussed above, substitution hybrid games can be configured with any component appropriate to the requirements of a specific application in accordance with embodiments of the invention. Network connected substitution hybrid games are discussed below.

Network Connected Substitution Hybrid Games

Substitution hybrid games in accordance with many embodiments of the invention can operate locally while being network connected to draw services from remote locations or to communicate with other substitution hybrid games. In many embodiments, operations associated with a substitution hybrid game such as (but not limited to) processes for calculating score or RWC and GWC tracking can be performed across multiple devices. These multiple devices can be implemented using a single server or a plurality of servers such that a substitution hybrid game is executed as a system in a virtualized space, such as (but not limited to) where the RWE and GWE are large scale centralized servers "in the cloud" coupled to a plurality of widely distributed ESE controllers or clients via the Internet.

In many embodiments, an RWE server can perform certain functionalities of a RWE of a substitution hybrid game. In certain embodiments, a RWE server includes a centralized odds engine which can generate random outcomes (such as but not limited to win/loss outcomes) for a gambling game, thereby eliminating the need to have that functionality of the RWE performed locally within the substitution hybrid game. The RWE server can perform a number of simultaneous or pseudo-simultaneous runs in order to generate random outcomes for a variety of odds percentages that one or more networked substitution hybrid games may require. In certain embodiments, an RWE of a substitution hybrid game can send information to a RWE server including (but not limited to) Table Ln-RWC tables, maximum speed of play for a gambling game, gambling game monetary denominations or any promotional RWC provided by the operator of the substitution hybrid game. In particular embodiments, a RWE server can send information to a RWE of a substitution hybrid game including (but not limited to) RWC used in the gambling game, player profile information or play activity and a profile associated with a player.

In several embodiments, a GWE server can perform the functionality of the GWE across various substitution hybrid games. These functionalities can include (but are not limited to) providing a method for monitoring high scores on select groups of games, linking groups of games in order to join them in head-to-head tournaments, and acting as a tournament manager. A substitution module can execute as part of a GWE server to coordinate the interaction between a human player and a substitution hybrid game that enables players of a multiplayer hybrid game to be substituted for a human player associated with a human player profile or a computer player associated with a computer player profile.

In a variety of embodiments, management of the activities of a human player's interactions with a substitution hybrid game and the human player's associated human player profile can be performed by a GWE patron management server separate from a GWE server. A GWE patron management server can manage information related to a human player profile, including (but not limited to) data concerning players' characters, players' game scores, players' RWC and GWC and managing tournament reservations. Although a GWE patron management server is discussed separate from a GWE server, in certain embodiments a GWE server also performs the functions of a GWE patron management server. In certain embodiments, a GWE of a substitution hybrid game can send information to a GW patron management server including (but not limited to) GWC and RWC used in a game, human player profile information, play activity and profile information for players and synchronization information between a gambling game and an entertainment game or other aspects of a substitution hybrid game. In particular embodiments, a GW patron management server can send information to a GWE of a substitution hybrid game including (but not limited to) entertainment game title and type, tournament information, Table Ln-GWC tables, special offers, character or profile setup and synchronization information between a gambling game and an entertainment game or other aspects of a substitution hybrid game. A substitution module can execute as part of a patron management server to enable substitutions between players of a multiplayer entertainment game, where the substituted players are associated with a human player profile or a computer player profile.

In numerous embodiments, an ESE server provides a host for managing head-to-head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

In several embodiments, a substitution server can be connected with a substitution hybrid game and can implement a substitution module to coordinate the activities of a substitution hybrid game. A substitution module can execute as part of a substitution server to enable substitutions between players of a multiplayer entertainment game, where the substituted players are associated with a human player profile or a computer player profile. In numerous embodiments, a substitution server can be part of a distributed system where processes of a substitution server occur across different substitution servers of a substitution server system.

Servers connected via a network to implement substitution hybrid games in accordance with many embodiments of the invention can communicate with each other to provide services utilized within a substitution hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the substitution hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of a substitution hybrid game tournament. Typically a GWE (such as a GWE that runs within a substitution hybrid game or on a GWE server) is not aware of the relationship of itself to the rest of a tournament since in a typical configuration the actual tournament play is managed by the ESE server. Therefore, management of a substitution hybrid game tournament can include (but is not limited to) tasks such as: conducting tournaments according to system programming that can be coordinated by an operator of the substitution hybrid game; allowing entry of a particular player into a tournament; communicating the number of players in a tournament and the status of the tournament (such as but not limited to the amount of surviving players, their status within the game, time remaining on the tournament); communicating the status of an ESE contained in a game; communicating the performance of its players within the tournament; communicating the scores of the various members in the tournament; and providing a synchronizing link to connect the GWEs in a tournament, with their respective ESE's.

In several embodiments a GWE server can communicate with a GW patron server. A GWE server can communicate with a GW patron server to communicate any type of information as appropriate for a specific application, including (but not limited to) information for configuring tournaments according to system programming conducted by an operator of a substitution hybrid game, exchange of data necessary to link a player's player profile to their ability to participate in various forms of sponsored gameplay (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game contained GWE and ESE performance to suit preferences of a player on a particular substitution hybrid game, as recorded in their human player profile, determining a player's play and gambling performance for the purposes of marketing intelligence, and logging secondary drawing awards, tournament prizes, RWC and GWC into the player profile.

In many embodiments, the actual location of where various algorithms and functions are executed may be located either in the game contained devices (RWE, GWE, ESE), on the servers (RWE server, GWE server, or ESE server), or a combination of both. In particular embodiments, certain functions of a RWE server, GWE server, GW patron server or ESE server may operate on the local RWE, GWE or ESE contained with a substitution hybrid game locally. In certain embodiments, a server is a server system including a plurality of servers, where software may be run on one or more physical devices. Similarly, in particular embodiments, multiple servers may be combined on a single physical device.

Figure 2:
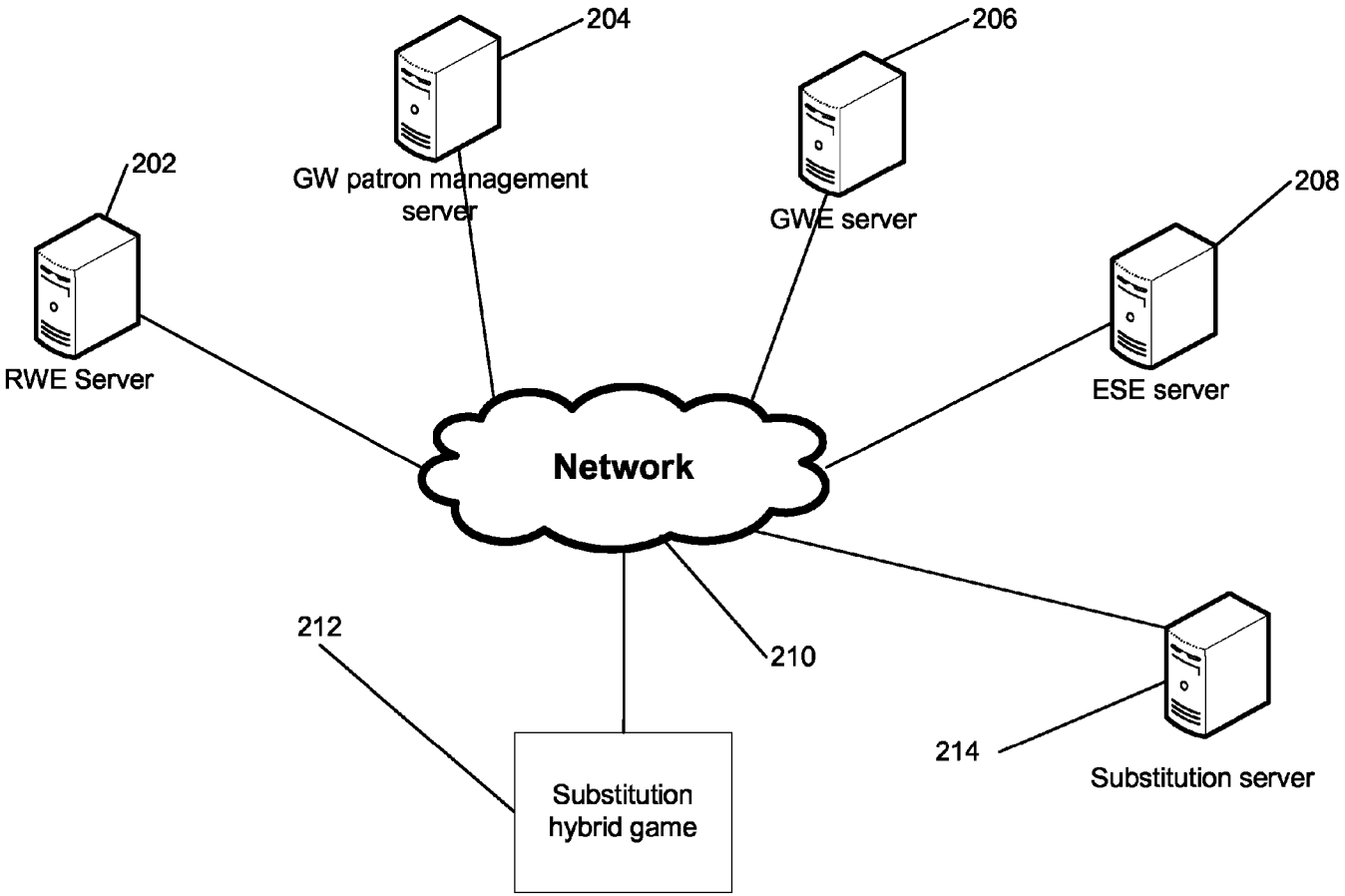
FIG. 2 is a system diagram that illustrates a network distributed substitution hybrid game in accordance with an embodiment of the invention.

Substitution hybrid games in accordance with many embodiments of the invention can be networked with remote servers in various configurations. A networked substitution hybrid game in accordance with an embodiment of the invention is illustrated in FIG. 2. The networked substitution hybrid game 212 is connected with a RWE server 202, GW patron management server 204, GWE server 206, ESE server 208 and a substitution server 214 over a network 210, such as (but not limited to) the Internet. Servers networked with a networked substitution hybrid game 212 can also communicate with each of the components of a networked substitution hybrid game and amongst the other servers in communication with the networked substitution hybrid game 212.

Although various networked substitution hybrid games are discussed above, networked substitution hybrid games can be configured in any manner as appropriate to the requirements of a specific application in accordance with embodiments of the invention. Substitution modules capable of coordinating the substitution of players with a human player associated with a human player profile or a computer player associated with a computer player profile on a substitution hybrid game are discussed below.

Substitution Modules

A substitution module in accordance with many embodiments of the invention can be utilized to coordinate the activities of a substitution hybrid game such as (but not limited to) substituting players in a multiplayer entertainment game for a human player associated with a human player profile or a computer player associated with a computer player profile. In numerous embodiments, a substitution module maintains information related to the coordination of substitutions, such as (but not limited to) human player profiles that include information concerning a human player of a substitution hybrid game, computer player profile profiles that include information concerning characteristics of a computer player and gameplay information enabling the seamless substitution of a player of a multiplayer game such that the players of a substitution hybrid game have the gameplay resources to seamlessly enter multiplayer gameplay.

Figure 3:
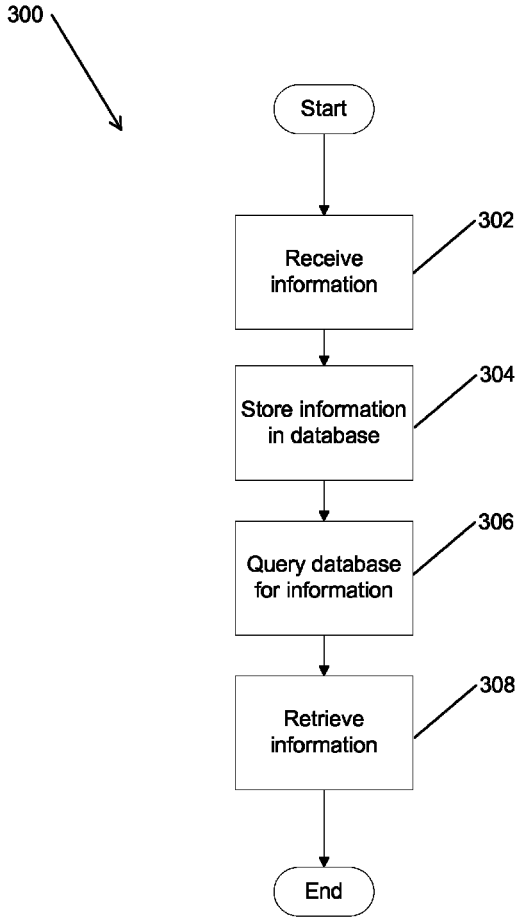
FIG. 3 is a flow chart of a process for storing and retrieving information using a database.

In many embodiments, a substitution module can utilize a database to store and retrieve information related to the substitution of players by the substitution of the player's associated player profiles. This information can be stored and retrieved according to metadata associated with the information in the database. The database can be any form of relational database system or flat file database system such as (but not limited to) a Structured Query Language (SQL) database or a SQLite database. In certain embodiments, a substitution module can utilize other forms of data storage including (but not limited to) a flat file. A flow chart of a process utilized by a substitution module for storing and retrieving information related to the substitution of players in a database is illustrated in FIG. 3. The process 300 includes receiving (302) information. In numerous embodiments, the information can be related to the coordination of substitutions, such as (but not limited to) human player profiles that include information concerning a human player of a substitution hybrid game, computer player profile profiles that include information concerning characteristics of a computer player and gameplay information enabling the seamless substitution of a player of a multiplayer game such that the players of a substitution hybrid game have the gameplay resources to seamlessly enter multiplayer gameplay. Once the information is received, it is stored (304) in the database using the substitution module. The substitution module can query (306) the database for the stored information utilizing metadata that describes the information from which the information can be identified. The metadata from which the information can be identified can be generated from the source of a query request such as (but not limited to) a human player or the substitution module. Once the information is found from the query (306), it can be retrieved (308) and utilized as appropriate to the requirements of a specific application. In certain embodiments, a substitution module can query a database for information concerning a substitution, such as by querying for information on a player's skill level stored in a player's player profile using metadata that refers to the information on a player's skill level. The information can then be retrieved and the information concerning a player's skill level can be utilized to determine whether a substitution of the player is in accordance with a substitution standard.

Although various configurations of substitution modules are discussed above, substitution modules can be configured in any manner as appropriate to the requirements of a specific application in accordance with embodiments of the invention. A variety of processes that can be executed by a substitution module are discussed below.

Initiating Gameplay with Computer Players

In many embodiments, a minimum number of players may be required for multiplayer gameplay in an entertainment game. When an insufficient number of human players are committed to a multiplayer game relative to a desired number of players, computer players generated using one or more computer player profiles may be introduced to meet that desired number of players. In several embodiments, when a minimum number of players for gameplay are not present from human players associated with human player profiles, computer players generated using computer player profiles will automatically be substituted for the missing players in order for the game to start. In certain embodiments with a racing type of entertainment game, the track may require at least four players to compete. If only two players from human players are available at the start, two automated players generated using at least one computer player profile may be introduced for competition to begin.

In numerous embodiments, substitution hybrid games utilize both RWC and GWC for gameplay. Play of an entertainment game can in part depend on payouts from wagers of RWC. Thereby, a RWE can conduct simulated wagers on behalf of computer players associated with computer player profiles and human players associated with human player profiles. The payouts from these wagers of RWC can be communicated to a GWE and gameplay progresses as though a human player associated with a human player profile obtained the results from a wager of RWC. The amount of RWC utilized by a RWE for a computer player can be determined by any standard, such as but not limited to a minimum starting amount of RWC for all players or average wager amounts.

In various embodiments, multiplayer play of a substitution hybrid game may require a certain RWC "buy-in" for groups of players or individual players to have the necessary EE, AE, CEE or other elements for meaningful gameplay progress. These EE may be used by an individual or by the group in common. In certain embodiments with a shooting type of entertainment game, an initial commitment of RWC (such as but not limited to 15 RWC credits) for play of a gambling game could result in a minimum amount of EE to initiate gameplay (such as but not limited to 100 units of ammunition) while computer players associated with computer player profiles may be provided the necessary EE without any initial RWC commitment requirement.

In numerous embodiments, EE may be a limiting factor in some entertainment games. In certain examples with a shooting type of entertainment game, an initial 100 units of EE/ammunition may be rapidly consumed by a machine gun, and a human player may be required to wager more RWC to continue gameplay. Similarly, a computer player can be limited to a specific range of EE/ammunition during gameplay. This range could be (but is not limited to) the average EE used during the course of a game by human players associated with human player profiles, a minimum starting amount of EE, or the maximum amount of EE obtained by any human player associated with a human player profile in a specific game.

In a number of embodiments, gameplay may use a collective pool of gameplay resources. In an entertainment game that is a real estate themed board game similar to the Monopoly board game distributed by Hasbro, Inc. headquartered in Pawtucket, R.I., the purchasable properties can be a limited, collected pool of EE. A group of players associated with player profiles may have to commit a minimum amount of RWC to gain access to the full range of properties for purchase. For instance, if a group commits 10 RWC, then the railroads and the green properties will be available for purchase. If a group commits 20 RWC, then the red and purple properties will also be available. When a computer player does not commit RWC to play, the difference can be made up from the human players.

In many embodiments, if a human player associated with a human player profile does not wish to wait for more participants, an election can be made to add computer players associated with computer player profiles to reach a desired number of players. In certain embodiments, if a human player requests to start gameplay without the required number of players, gameplay can be initiated by allocating a certain amount of RWC from the human player profile associated with the human player as a fee as set by the substitution hybrid game despite the fact that the required number of players are not present for that gameplay session. In particular embodiments, human players associated with human player profiles must contribute more RWC in order to start gameplay with a computer player as opposed to playing with a human player.

In a number of embodiments, a substitution hybrid game may seek to increase the number of gameplay sessions played on the substitution hybrid game. This could require the requisite number of players for a gameplay session to form more rapidly by using computer players when an appropriate human player cannot be found quickly. In particular embodiments, human players can compete against computer players. This option may include a reduced RWC wagering requirement, providing a discount for gameplay with a computer player as opposed to playing with a human player.

In many embodiments, a substitution standard can be set by a human player with an associated human player profile that dictates the conditions in which a computer player with an associated computer player profile can be substituted for a missing player in order to initiate a gameplay session. In certain embodiments, a human player associated with a human player profile can indicate a preference or a requirement that gameplay exclude computer players via a user interface within the substitution hybrid game or within a human player profile as a substitution standard. Similarly, human players can generate substitution standards concerning whether or not computer players can be substituted for missing players, or to always wait until more human players are available for gameplay collaboration instead of initiating gameplay with computer players. In particular embodiments with a chess based entertainment game, a human player can generate a substitution standard by which the human player only enters a gameplay session with players/opponents that are associated with human player profiles and not computer player.

In many embodiments, a human player can generate a substitution standard that effectuates a preference to play against human players but to substitute computer players for missing players after a certain amount of time has elapsed. In certain embodiments with a racing type of entertainment game, if the entertainment game starts with a human player and two computer players, a human player may indicate that it does not want any opponents replaced.

In many embodiments, a substitution standard can require that a computer player with an associated computer player profile can be selected based upon the human player profiles of the human players participating in a gameplay session. The computer players with an associated computer player profiles can be selected based upon any characteristic of the human player profiles including (but not limited to) the average human player profile's skill level.

Figure 4:
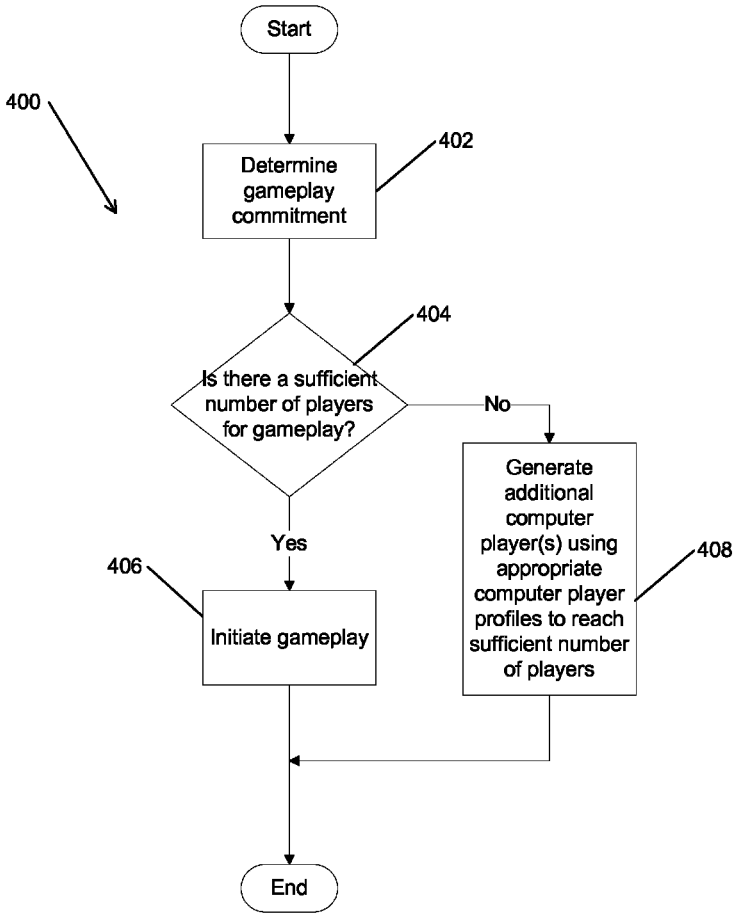
FIG. 4 is a flow chart of a process for adding computer players to reach a sufficient number of players in multiplayer gameplay in accordance with an embodiment of the invention.

A flow chart of a process for adding computer players to reach a sufficient number of players in multiplayer gameplay in accordance with an embodiment of the invention is illustrated in FIG. 4. The process 400 includes determining (402) gameplay commitments from human players associated with human player profiles. A decision (404) can be made as to whether there are a sufficient number of players committed to gameplay. If there are a sufficient number of players, then gameplay is initiated (406) and the process ends. If there are an insufficient number of human players, then computer players associated with computer player profiles can be substituted (408) in for the missing players to reach the required number of players and the process ends.

Although various configurations of substitution modules for initiating gameplay utilizing computer players are discussed above, substitution hybrid games can be configured in any manner appropriate to the requirements of a specific application in accordance with embodiments of the invention. Substituting computer players with human players using a substitution module in accordance with an embodiment of the invention is discussed below Substituting Human Players for Computer Players Substitution modules in accordance with many embodiments of the invention can coordinate the substitution of a human player associated with a human player profile for a computer player associated with a computer player profile during play of the substitution hybrid game. Without proper coordination, a human player entering gameplay as an additional player during a gameplay session may have a disruptive impact on gameplay. To illustrate this point, a new player joining after gameplay has started would have to be allocated EE that may be assigned to another player if there is only a fixed amount of EE in an entertainment game. This shift in EE or other gameplay resources could dramatically change gameplay and strategy. Therefore, a replacement of a human player with a computer player would minimize the impact of adding a human player to an ongoing gameplay session.

In numerous embodiments, play of a substitution hybrid game utilizes both RWC and GWC. Progress in an entertainment game and the accumulation of GWC can in part depend on the payouts of RWC wagers made in a gambling game. Play of a gambling game with wagers of GWC can have already begun when a human player is substituted for a computer player. In many embodiments, a human player associated with a human player profile can be required to commit an amount of RWC or other gameplay resources before the human player can be substituted for a computer player.

In many embodiments, only human players with characteristics that meet certain substitution standards can be substituted for particular computer players in ongoing gameplay. In certain embodiments, the substitution standard can include that the human player's associated human player profile must be rated to have the same skill level (or other skill based characteristics) as the computer player profile that the human player profile is substituting for. In certain embodiments, a computer player with a computer player profile rated at a low skill level may only be replaced with a human player with a human player profile whose play is also rated at a low skill level, rather than with a human player associated with a human player profile rated at any skill level.

In numerous embodiments, a substitution standard can dictate that a human player associated with a human player profile can substitute for a computer player associated with a computer player profile only upon certain events within a gameplay session. These events can occur (but are not limited to occurring) after an amount of real or virtual time has elapsed, after certain gameplay events have occurred, or after some portion of EE is consumed. In certain embodiments with an entertainment game modeled after the Battleship game distributed by Hasbro Inc. headquartered in Pawtucket, R.I., a human player can substitute for a computer player only if less than 10 minutes of real time has passed in a gameplay session, no ships have been hit, or if less than half of the available EE has been consumed. In many embodiments, a human player can substitute for a computer player at any point during a gameplay session.

In several embodiments, a human player associated with a human player profile can promulgate a substitution standard as to how the human player is to be substituted for a computer player. The human player can provide information concerning a substitution standard directly to a substitution hybrid game and/or via the player's associated human player profile. These substitution standards can relate to such aspects as (but are not limited to) indicating at which stage the human player can enter a session of gameplay. In certain embodiments with an entertainment game based upon Battleship, if a human has indicated a preference for entering a gameplay session before any ships have been sunk, then the human player will not be substituted for a computer player in a gameplay session where ships have already been destroyed. In a number of embodiments, a human player can indicate that it does not want the computer players or human players to be replaced with any player during gameplay.

Figure 5:
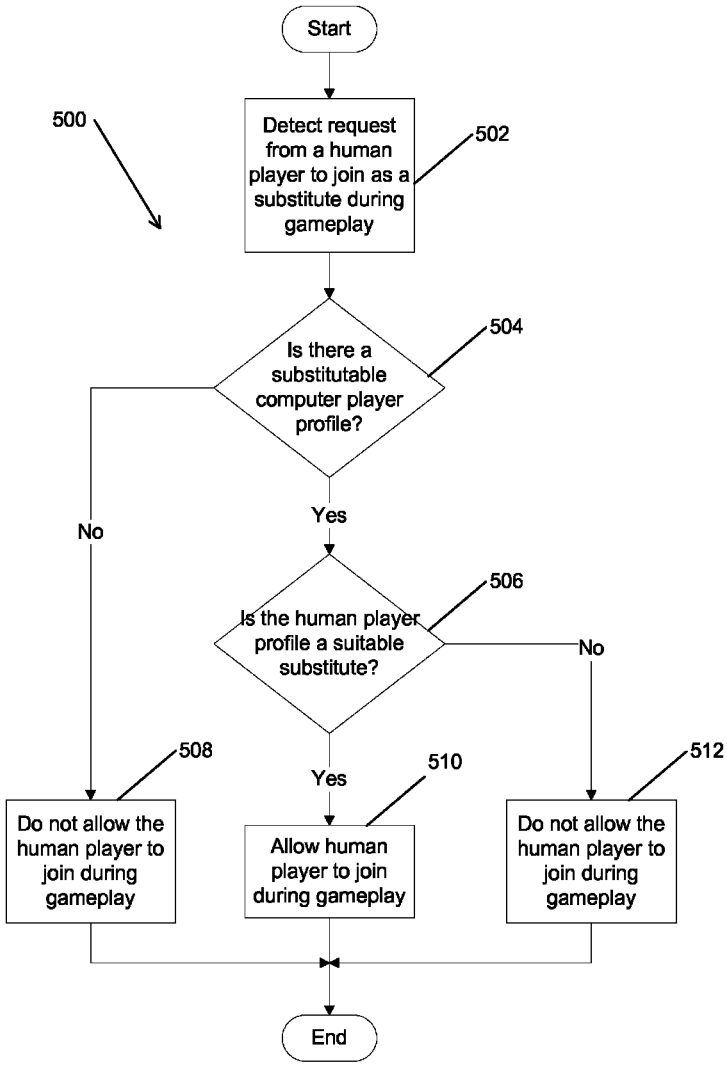
FIG. 5 is a flow chart of a process for processing a request from a human player to substitute for a computer player during a gameplay session in accordance with an embodiment of the invention.

A flow chart of a process of processing a request from a human player with an associated human player profile to join as a substitute player that replaces a computer player generated using an associated computer player profile during multiplayer gameplay using a substitution module in accordance with an embodiment of the invention is illustrated in FIG. 5. The process 500 includes detecting (502) a request from a human player associated with a human player profile to join a game as a substitute player that replaces a computer player during gameplay. The request is typically received via a user interface generated by the substitution hybrid game. A decision (504) is made as to whether there is a substitutable computer player with an associated computer player profile in that gameplay session that can be replaced by the human player according to a substitution standard that governs the types of computer players that can be substituted out of a gameplay session. If the substitution standard governing the types of computer players that can be substituted out of a gameplay session is not satisfied, then the requesting human player is not allowed (508) to substitute for a computer player during the gameplay session and the process ends. If the substitution standard that governing the types of computer players that can be substituted out of a gameplay session is satisfied, then a decision (506) is made as to whether the human player can substitute for a computer player according to the substitution standard that governs the types of human players that can be substituted into a gameplay session. If the substitution standard that governs the types of human players that can be substituted into a gameplay session is not satisfied, then the human player profile is not allowed (512) to substitute for a computer player profile and the process ends. If the substitution standard that governs the types of human players that can be substituted into a gameplay session is satisfied, then the human player profile is allowed (510) to substitute for a computer player profile and joins the gameplay session in place of a computer player that satisfies the substitution standard that governs the types of computer players that can be substituted out of a gameplay session and the process ends.

Figure 6:
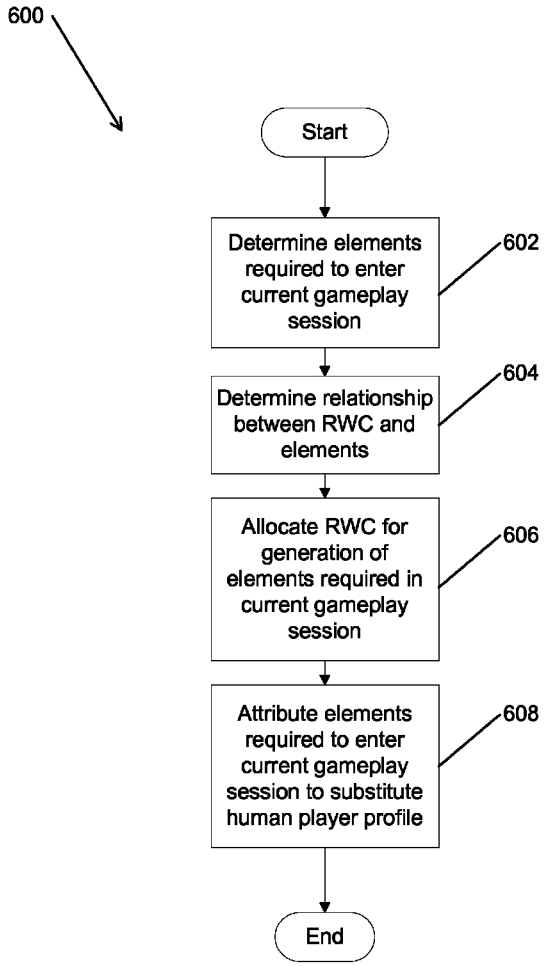
FIG. 6 is a flow chart of a process for allocating elements used in gameplay for a substitute human player to enter ongoing multiplayer gameplay in accordance with an embodiment of the invention.

In several embodiments, play of a substitution hybrid game can require each human player associated with a human player profile to pay a certain amount of RWC in order to commence gameplay. When a human player substitutes for a computer player, the human player profile of the human player can be required to contribute a proportional amount of RWC for the amount of time remaining in the gameplay session prior to entering gameplay. This proportional amount can be related to (but is not limited to) average game length, amount already wagered, or amount of EE available. A process of ascribing elements necessary for a substitute human player associated with a human player profile to enter ongoing multiplayer gameplay using a substitution module in accordance with an embodiment of the invention is illustrated in FIG. 6. The process 600 includes determining (602) the elements that are required to enter the current gameplay session. The process also includes determining (604) a relationship between RWC and elements. Then, RWC can be allocated (606) from the RWC associated with the substitute human player's human player profile in order to ascribe (608) the elements required to enter a current gameplay session to the human player profile of the substitute human player.

Although various configurations of substitution modules for substituting computer players with human players are discussed above, substitution hybrid games can be configured in any manner appropriate to the requirements of a specific application in accordance with embodiments of the invention. Substituting human players with computer players using a substitution module are discussed below Substituting Computer Players for Human Players Substitution modules in accordance with many embodiments of the invention can coordinate the substitution of a computer player for a human player during play of the substitution hybrid game. A computer player can be substituted for a human player for many reasons, including a desire from the human player of the human player profile to end gameplay. Rather than just ending a gameplay session when a human player of a multiplayer sponsored hybrid game elects to end that human player's gameplay session, a substitution module can coordinate the substitution of a computer player for that human player.

In numerous embodiments, the computer player can be a substitute player in compliance with substitution standards which require that the computer player's player profile be a close match to the human player's player profile that the computer player is substituting for in order to provide as little disruption as possible to the gameplay session of the substitution hybrid game. These substitution standards can require (but are not limited to requiring) that the substitute computer player's player profile have a same skill level as the human player's player profile that the computer player is substituting for or a same style of play as the human player (such as based upon information garnered from historical gameplay information). In certain embodiments with a shooting type of entertainment game, a human player shooting with 90% accuracy would be replaced with a computer player shooting with 90% accuracy. Similarly, in embodiments with a sword-fighting type of entertainment game, a human player with a play history of that mostly utilizes a two-handed sword would be replaced with a computer player that mostly utilizes a two-handed sword. In many embodiments, the computer player that is used to make a substation is generated using a previously created computer player profile. In several embodiments, the computer player profile is dynamically generated based upon the human player profile that is the subject of the substation.

In several embodiments, substitution standards can require that a substitute computer player's player profile be a close match to the average performance of the player profiles of the other players participating in a gameplay session. In certain embodiments utilizing a shooting type of entertainment game, if the average player of that entertainment game shoots with 80% accuracy, then the substitute computer player can be configured to shoot with 80% accuracy, regardless of the shooting accuracy of the human player that is substituted out by the computer player.

In several embodiments, the substitution standards can require that a substitute computer player have a dynamically adjusted skill level in accordance with gameplay events in order to provide as little disruption as possible to the gameplay session of the substitution hybrid game. In certain embodiments, a substitute computer player can have its skill level adjusted during gameplay to match a change in skill level detected from the other players during a gameplay session.

Figure 7:
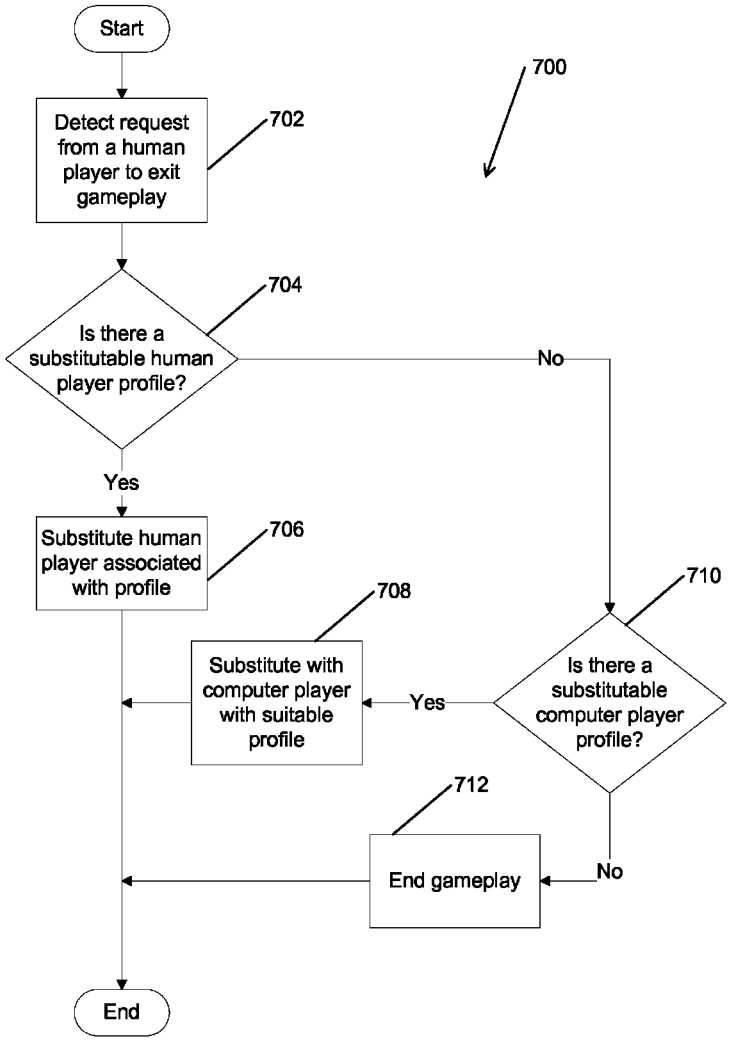
FIG. 7 is a flow chart of a process for processing a request from a human player to leave a gameplay session in accordance with an embodiment of the invention.

A process for handling a request from a human player with an associated human player profile to leave multiplayer gameplay in accordance with an embodiment of the invention is illustrated in FIG. 7. The process 700 includes detecting (702) a request from a human player to exit multiplayer gameplay. In many embodiments, the request can be received via a user interface generated by the substitution hybrid game. A decision (704) is made as to whether there is a substitutable human player available based upon an associated human player profile and a substitution standard that governs the types of human players that can be substituted into a gameplay session. In several embodiments, the substitution standard that governs the types of human players that can be substituted into a gameplay session can consider various characteristics of the players found in the players' player profiles. If the substitution standard that governs the types of human players that can be substituted into a gameplay session is met, then a human player is substituted (706) and the process ends. If the substitution standard that governs the types of human players that can be substituted into a gameplay session is not met, then a decision (710) is made as to whether there is a substitutable computer player that can be substituted in accordance with a substitution standard that governs the types of computer players that can be substituted into a gameplay session. If the substitution standard that governs the types of computer players that can be substituted into a gameplay session is met, then the human player is substituted (708) with a computer player and the process ends. If the substitution standard that governs the types of computer players that can be substituted into a gameplay session is not met, then gameplay ends (712) for all players of that gameplay session (assuming the minimum player requirement is no longer met) or the gameplay session continues with a reduced number of players.

Although various configurations of substitution modules for substituting human players with computer players are discussed above, substitution hybrid games can be configured in any manner appropriate to the requirements of a specific application in accordance with embodiments of the invention. Substituting human players with other human players using a substitution module is discussed below Substituting Human Players Substitution modules in accordance with many embodiments of the invention can coordinate the replacement of a human player with another human player during play of the substitution hybrid game. The substitution can be made in accordance with one or more substitution standards that require that the human player profile of the substitute human player is similar to the substituting human player profile to minimize the impact of the substitution on gameplay. The substituting human player can be a human player that coincidentally indicates a desire to substitute into a gameplay session when another human player desires to leave the gameplay session or a human player that stands by to wait for a human player to leave a gameplay session. One or more substitution standards concerning whether a human player can be substituted for another human player can include (but is not limited to) the human player that has been waiting the longest to be substituted, and/or the human player with the most similar characteristics as the human player to be substituted. The characteristics can include (but are not limited to) the human player profiles of the players indicating the same or a similar skill level and/or the same or a similar style of play.

Although various configurations of substitution modules for substituting human players with other human players are discussed above, substitution hybrid games can be configured in any manner appropriate to the requirements of a specific application in accordance with embodiments of the invention. Personalization of substitution hybrid games are discussed below Personalization of Substitution Hybrid Games Substitution hybrid games in accordance with many embodiments of the invention enable a substitution hybrid game to execute in a manner personalized to a human player by storing information concerning a human player's personalized preferences in a human player profile. In many embodiments, options for personalization can be selected through a player's user interface (such as but not limited to an entertainment game user interface) and communicated to a GWE or a substitution module. The options for personalization associated with a human player profile can affect any aspect of a substitution hybrid game including (but not limited to) whether the human player desires to be substituted into gameplay, substituted from gameplay, exit gameplay or how other players participating in gameplay can be substituted. The options for personalization can be presented in a player's user interface or received at a player's user interface at any time.

In numerous embodiments, a substitution hybrid game can allow a player to access information useful to the player in personalizing the substitution hybrid game, such as to display a demonstration on game use and possible outcomes from different modifications of substitution hybrid game parameters (such as but not limited to RWC available to the gambling game, game play time and entertainment game difficulty setting) that a player can make to personalize the substitution hybrid game. Also, a player may manually personalize a game, such as by (but not limited to) setting the difficulty setting at which the substitution hybrid game is performing, determining the conversions between elements, real world credits (RWC) and game world credits (GWC), setting game play time or goals to be reached during gameplay, setting up a player profile or settings for interactions with a virtual community.

Figure 8A:
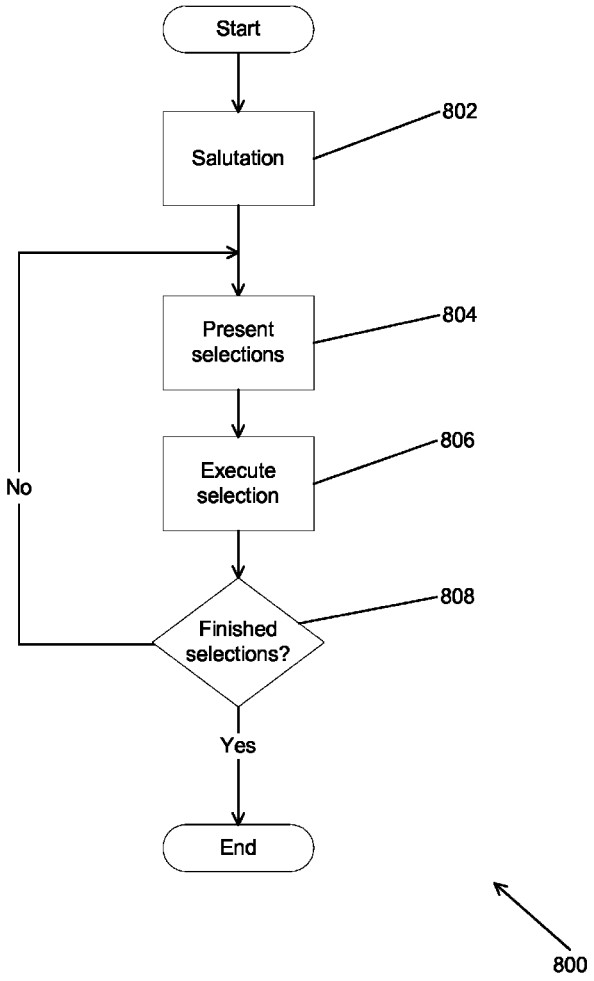
FIG. 8A is a flow chart of a process for interacting with a substitution hybrid game using a user interface in accordance with an embodiment of the invention.

A process for personalizing a substitution hybrid game based on human player selections to be associated with a human player in the human player's human player profile is illustrated in FIG. 8A. The process 800 includes a salutation (802) from the substitution hybrid game presented via the game's user interface. After the salutation (802), the substitution hybrid game presents (804) selections among different options via the user interface. After polling (804) for a selection, the substitution hybrid game executes (806) the selection. A decision (808) is made as to whether selections are finished in personalizing the substitution hybrid game. If the selections are not finished, the process 800 loops back to polling for (additional) selections. If the selections are finished, the process is complete.

Figure 8B:
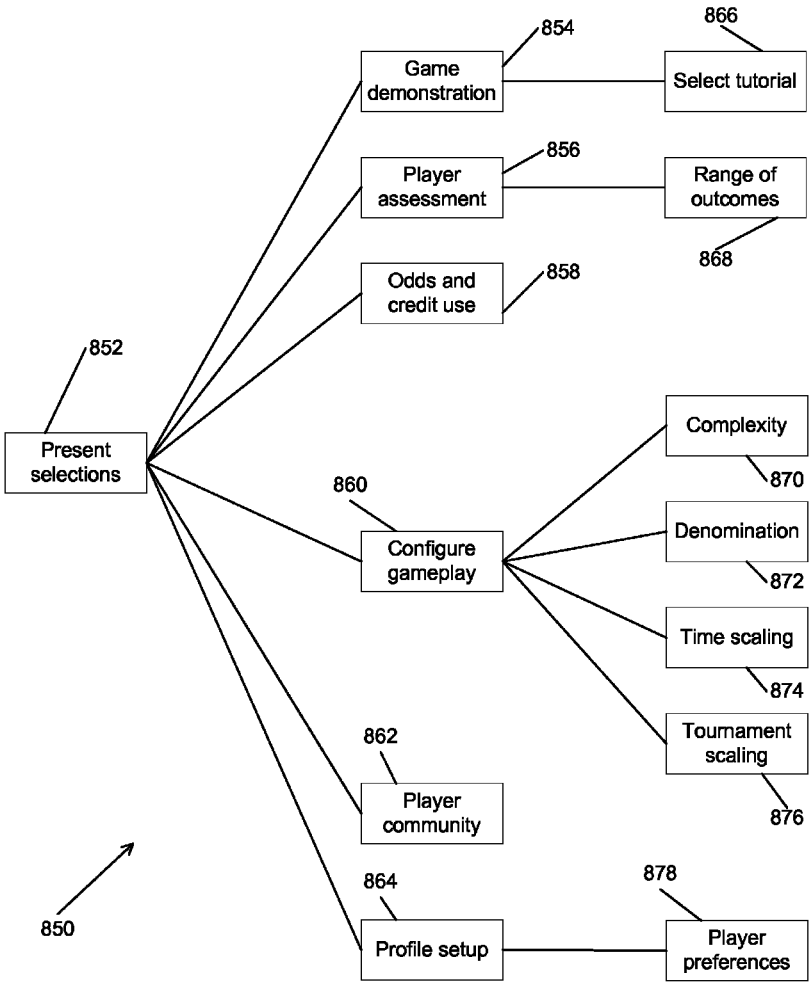
FIG. 8B is a decision tree illustrating various selections that can be made by a human player via a user interface to configure a human player profile in accordance with an embodiment of the invention.

A decision tree illustrating various selections associated with a human player profile that can be presented to a player via a user interface generated by a substitution hybrid game in accordance with an embodiment of the invention is illustrated in FIG. 8B. The decision tree 850 illustrates how selections 852 of information that can be presented in more detail or selections to configure a human player profile can be accessed on a user interface. These selections can include any number of selections, including (but not limited to) a selection to receiving information on game demonstration 854, player assessment 856, information on odds and credit use 858, gameplay configurations 860, interactions with a player community 862 and player profile setup 864. A game demonstration 854 can include (but is not limited to) a specific tutorial game demonstration and can be selected 866 for presentation via the user interface. A presentation on player assessment 856 can include (but is not limited to) a range of outcomes that can occur based upon the player's characteristics 868. Options to configure gameplay 860 can include (but are not limited to) options to configure gameplay such as selections to configure gameplay complexity 870, denomination of wagers made in a gambling game 872, time scaling 874 and tournament scaling 876. Options to set up a player profile 864 can include (but are not limited to) a number of selectable player preferences 878 that can be used to set up a player profile.

Although specific options are discussed above that enable a player to personalize a substitution hybrid game, a substitution hybrid game can be personalized in any way as appropriate to the requirements of a specific application in accordance with embodiments of the invention. A discussion of processing apparatuses that can implement a substitution hybrid game is below.

Processing Apparatus

Figure 9:
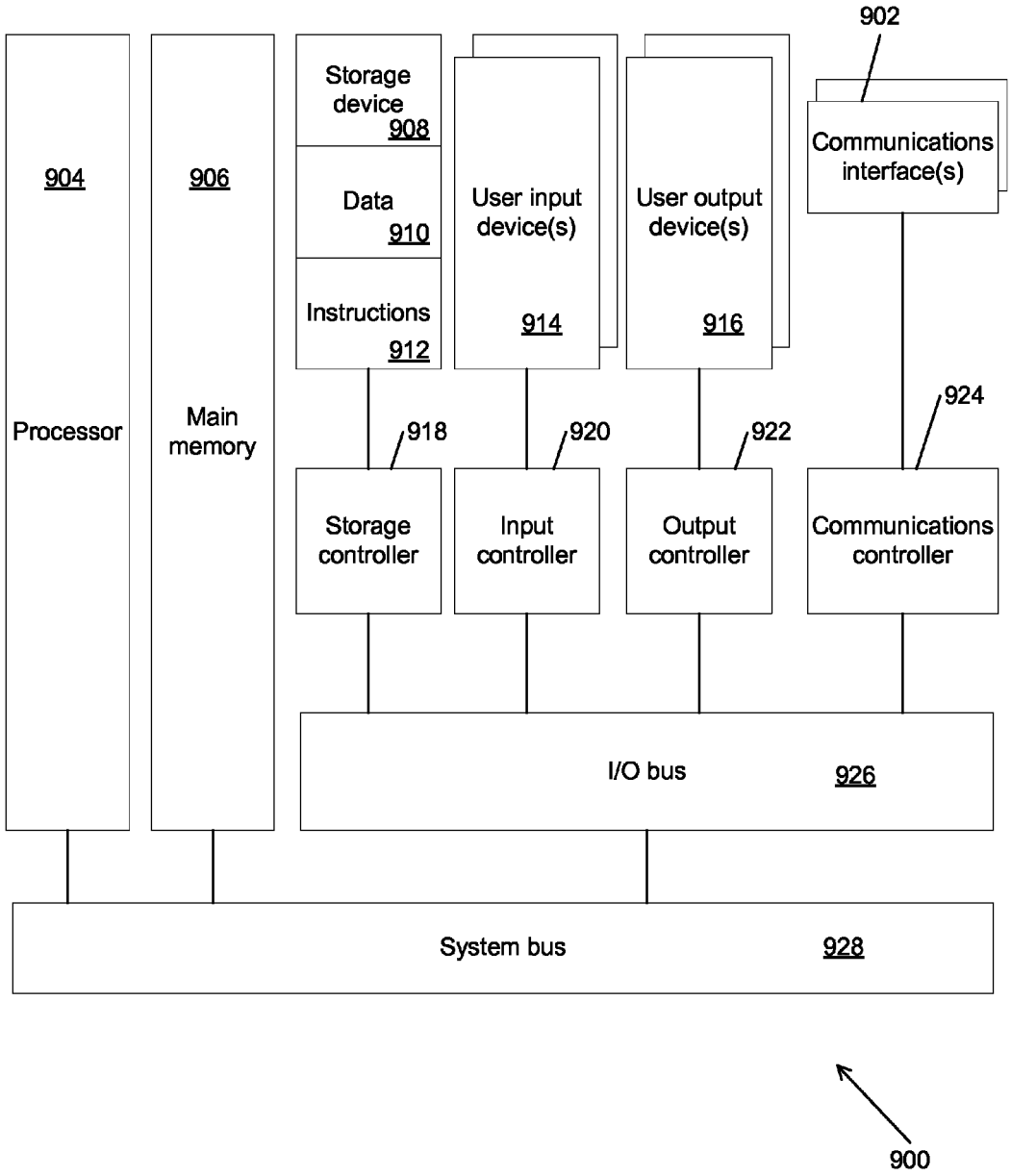
FIG. 9 illustrates a hardware architecture diagram of a processing apparatus utilized in the implementation of a substitution hybrid game in accordance with an embodiment of the invention.

Any of a variety of processing apparatuses can host various components of a substitution hybrid game in accordance with embodiments of the invention. In several embodiments, these processing apparatuses can include, but are not limited to, a gaming machine, a general purpose computer, a computing device and/or a controller. A processing apparatus that is constructed to implement a substitution hybrid game in accordance with an embodiment of the invention is illustrated in FIG. 9. In the processing apparatus 900, a processor 904 is coupled to a memory 906 by a bus 928. The processor 904 is also coupled to non-transitory processor-readable storage media, such as a storage device 908 that stores processor-executable instructions 912 and data 910 through the system bus 928 to an I/O bus 926 through a storage controller 918. The processor 904 is also coupled to one or more interfaces that may be used to connect the processor to other processing apparatuses as well as networks as described herein. The processor 904 is also coupled via the bus to user input devices 914, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 904 is connected to these user input devices 914 through the system bus 928, to the I/O bus 926 and through the input controller 920. The processor 904 is also coupled via the bus to user output devices 916 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 928 to the I/O bus 926 and through the output controller 922. The processor 904 can also be connected to a communications interface 902 from the system bus 928 to the I/O bus 926 through a communications controller 924.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, GWE or ESE as described herein can be implemented on multiple processing apparatuses, whether dedicated, shared or distributed in any combination thereof, or may be implemented on a single processing apparatus. In addition, while certain aspects and features of element management processes described herein have been attributed to an RWE, GWE, or ESE, these aspects and features may be implemented in a hybrid form where any of the features or aspects may be performed by any of a RWE, GWE, ESE within a substitution hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A substitution hybrid game, comprising:

a real world engine constructed to provide a randomly generated payout of real world credits from at least one wager in a gambling game;

an entertainment software engine constructed to execute a multiplayer entertainment game providing outcomes upon a player's skillful execution of the entertainment game to earn a payout of game world credits; and a game world engine constructed to manage the entertainment software engine and communicate gameplay gambling event occurrences based upon a player's skillful execution of the entertainment game that trigger at least one wager in the gambling game, on the basis of consumption by the player of enabling elements that enable a player's play of the entertainment game and whose consumption by the player through skillful play of the entertainment game trigger a wager in the gambling game, to the gambling game, wherein the game world engine utilizes a substitution module constructed to access a database containing player profiles associated with players of the substitution hybrid game, and the substitution module is constructed to:

detect a substitution request from a human player to replace a player of the multiplayer entertainment game via a user interface concerning a gameplay session, where a player profile within the database describes the human player, the player profile including an amount of real world credit that can be expended to generate enabling elements in the gameplay session, and an accumulation of game world credits accrued by the human player as a function of the human player's demonstrated skill at the multiplayer entertainment game;

evaluate whether the substitution request involves a substitution of the player by the human player players that satisfies at least one substitution standard using at least the player profile that describes the human player, the at least one substitution standard including allowing the human player to substitute for the player when the human player's player profile is attributed with a sufficient amount of real world credit that can be expended to generate enabling elements in the gameplay session, and the human player's demonstrated skill matches the player's skill level as determined on the basis of the accumulation of game world credits accrued by the human player as a function of the human player's demonstrated skill at the multiplayer entertainment game; and perform a player substitution in accordance with the substitution request when the substitution request satisfies the at least one substitution standard.

2. The substitution hybrid game of claim 1, wherein:

the substitution request is for the human player to substitute for a computer player engaged in the gameplay session; and the computer player is generated using a computer player profile that determines a performance of the computer player as the computer player progresses within the gameplay session.

3. The substitution hybrid game of claim 1, wherein the substitution request is for the human player to substitute for a human player engaged in the gameplay session.

4. The substitution hybrid game of claim 1, wherein the substitution module is further constructed to:

detect whether a minimum number of players is present; and add at least one computer player generated using a computer player profile when the minimum number of players is not present, where the computer player profile determines the performance of a computer player as a computer player progresses within the gameplay session.

5. The substitution hybrid game of claim 1, wherein at least one substitution standard is specified by the human player in the gameplay session.

6. The substitution hybrid game of claim 1, wherein the substitution module is constructed to execute on the game world engine.

7. The substitution hybrid game of claim 1, wherein the substitution module is constructed to execute on a substitution server and communicate with the game world engine via a network.

8. The substitution hybrid game of claim 1, wherein the substitution module is constructed to execute on a game world patron management server and communicate with the game world engine via a network.

9. The substitution hybrid game of claim 1, wherein the requested player substitution is performed by the human player assuming the role of the player that the human player substitutes for in the gameplay session.

10. A method of operating a substitution hybrid game, the method comprising:

providing a real world engine constructed to provide a randomly generated payout of real world credits from at least one wager in a gambling game;

providing an entertainment software engine constructed to execute a multiplayer entertainment game providing outcomes upon a player's skillful execution of the entertainment game to earn a payout of game world credits;

providing a game world engine constructed to manage the entertainment software engine and communicate gameplay gambling event occurrences based upon a player's skillful execution of the entertainment game that trigger at least one wager in the gambling game, on the basis of consumption by the player of enabling elements that enable a player's play of the entertainment game and whose consumption by the player through skillful play of the entertainment game trigger a wager in the gambling game, to the gambling game;

detecting a substitution request from a human player to replace a player of the multiplayer entertainment game via a user interface concerning a gameplay session, where a player profile describes the human player, the player profile including an amount of real world credit that can be expended to generate enabling elements in the gameplay session, and an accumulation of game world credits accrued by the human player as a function of the human player's demonstrated skill at the multiplayer entertainment game;

evaluating whether the substitution request involves a substitution of the player by the human player that satisfies at least one substitution standard using at least the player profile that describes the human player, the at least one substitution standard including allowing the human player to substitute for the player when the human player's player profile is attributed with a sufficient amount of real world credit that can be expended to generate enabling elements in the gameplay session, and the human player's demonstrated skill matches the player's skill level as determined on the basis of the accumulation of game world credits accrued by the human player as a function of the human player's demonstrated skill at the multiplayer entertainment game; and perform a player substitution in accordance with the substitution request when the substitution request satisfies the at least one substitution standard.

11. The method of claim 10, wherein:

the substitution request is for the human player to substitute for a computer player engaged in the gameplay session; and the computer player is generated using a computer player profile that determines a performance of the computer player as the computer player progresses within the gameplay session.

12. The method of claim 10, wherein the substitution request is for the human player to substitute for a human player engaged in the gameplay session.

13. The method of claim 10, wherein:

the human player is engaged in the gameplay session; and the substitution request is for a player to substitute for the human player.

14. A non-transitory machine readable medium containing processor instructions, where execution of the instructions by a processor causes the processor to perform a process comprising:

providing a real world engine constructed to provide a randomly generated payout of real world credits from at least one wager in a gambling game;

providing an entertainment software engine constructed to execute a multiplayer entertainment game providing outcomes upon a player's skillful execution of the entertainment game to earn a payout of game world credits; and providing a game world engine constructed to manage the entertainment software engine and communicate gameplay gambling event occurrences based upon a player's skillful execution of the entertainment game that trigger at least one wager in the gambling game, on the basis of consumption by the player of enabling elements that enable a player's play of the entertainment game and whose consumption by the player through skillful play of the entertainment game trigger a wager in the gambling game, to the gambling game;

detecting a substitution request from a human player to replace a player of the multiplayer entertainment game via a user interface concerning a gameplay session, where a player profile describes the human player, the player profile including an amount of real world credit that can be expended to generate enabling elements in the gameplay session, and an accumulation of game world credits accrued by the human player as a function of the human player's demonstrated skill at the multiplayer entertainment game;

evaluating whether the substitution request involves a substitution of the player by the human player that satisfies at least one substitution standard using at least the player profile that describes the human player, the at least one substitution standard including allowing the human player to substitute for the player when the human player's player profile is attributed with a sufficient amount of real world credit that can be expended to generate enabling elements in the gameplay session, and the human player's demonstrated skill matches the player's skill level as determined on the basis of the accumulation of game world credits accrued by the human player as a function of the human player's demonstrated skill at the multiplayer entertainment game; and perform a player substitution in accordance with the substitution request when the substitution request satisfies the at least one substitution standard.

* * * * *